US011974710B2

(12) United States Patent
Zhou

(10) Patent No.: US 11,974,710 B2
(45) Date of Patent: May 7, 2024

(54) MOP BUCKET AND CLEANING TOOL HAVING THE SAME

(71) Applicant: ZHEJIANG LIVINGHUE HOUSEWARE PRODUCTS CO., LTD, Jinhua (CN)

(72) Inventor: Weiming Zhou, Jinhua (CN)

( * ) Notice: Subject to any disclaimer, the term of this patent is extended or adjusted under 35 U.S.C. 154(b) by 211 days.

(21) Appl. No.: 17/575,694

(22) Filed: Jan. 14, 2022

(65) Prior Publication Data

US 2022/0133122 A1 May 5, 2022

(30) Foreign Application Priority Data

Mar. 16, 2021 (CN) ..... 202120542789.9

(51) Int. Cl.
*A47L 13/58* (2006.01)

(52) U.S. Cl.
CPC ..... *A47L 13/58* (2013.01)

(58) Field of Classification Search
CPC ..... A47L 13/58
USPC ..... 15/119.1
See application file for complete search history.

(56) References Cited

U.S. PATENT DOCUMENTS

| | | | | |
|---|---|---|---|---|
| 2007/0294853 | A1 | 12/2007 | Escarpa Gil | |
| 2018/0028040 | A1* | 2/2018 | Delangue | B08B 3/02 |
| 2020/0323334 | A1 | 10/2020 | Danko | |
| 2021/0076895 | A1 | 3/2021 | He et al. | |

* cited by examiner

*Primary Examiner* — Tom Rodgers
(74) *Attorney, Agent, or Firm* — Zhigang Ma

(57) ABSTRACT

The present disclosure relates to the technical field of cleaning tools, and discloses a mop bucket and a cleaning tool having the same. Through quantitative use of water for one cleaning and direct spin-drying after cleaning, the cleaning tool is convenient for operation and energy-efficient.

7 Claims, 7 Drawing Sheets

MOP BUCKET AND CLEANING TOOL HAVING THE SAME

TECHNICAL FIELD

The present disclosure relates to the technical field of cleaning tools, and in particular to a mop bucket and cleaning tool having the same.

BACKGROUND

In cleaning with existing cleaning tools, clean water is used at the start of cleaning. As the cleaning proceeds, the clean water turns into sewage which cannot be separated from the clean water. Thus, with the proceeding of the cleaning process, water in the mop bucket is increasingly dirty such that it is impossible to realize an effect of further cleaning and the water has to be poured away.

A Chinese patent, with Announcement No. CN211484438U, discloses a cleaning tool which includes a mop bucket and a mop. The mop includes a mop rod and a rotatable mop head; the mop rod includes an inner rod and an outer rod; the inner rod and the outer rod can be rotated by each other and can be shortened or lengthened; a cleaning cavity and a water storage cavity are disposed in the mop bucket; a support device and a water pumping structure are disposed in the cleaning cavity; a lifting device matching the support device is disposed in the rotatable mop head; and the lifting device includes a cleaning position and a dewatering position. When in cleaning, the lifting device is located at the cleaning position, the rotatable mop head is in butt joint with the support device and the water pumping structure, and by down pressing the mop rod, the rotatable mop head rotates and drives the water pumping structure to pump the water in the cleaning cavity to a wiping object of the rotatable mop head. When in dewatering, the lifting device can lift the rotatable mop head to the dewatering position, the rotatable mop head is released from the butt joint with the water pumping structure, and by down pressing the mop rod, the rotatable mop head rotates unidirectionally relative to the support device to realize dewatering.

In the above solution, dewatering of the mop is controlled by the lifting device in the mop, and spin-drying can be carried out only after the lifting device lifts the rotatable mop head to the dewatering position to separate the rotatable mop head from the water pumping structure. At the time, although the mop is separated from the support device, the support device remains in butt joint with the water pumping structure, thus, the water pumping structure is still rotating, and the clean water in the water storage cavity is still being supplied into the cleaning cavity, causing waste of the clean water.

SUMMARY

A first objective of the present disclosure is to provide a mop bucket to further improve the utilization of clean water.

To solve the above-mentioned technical problem, the present disclosure provides the following technical solution: A mop bucket, including an outer bucket and a clean water bucket located in the outer bucket, and a sewage accommodating cavity being formed between the outer bucket and the clean water bucket, wherein a water accommodating part is fixedly disposed in the clean water bucket; the water accommodating part is equipped with a water accommodating cavity capable of accommodating water required for one cleaning period; a clean bucket cover is disposed on the clean water bucket; a water pumping structure capable of pumping water in the water accommodating part to above the clean bucket cover is disposed in the water accommodating part; water seepage holes communicated with the clean water bucket and enabling clean water in the clean water bucket to drop into the water accommodating cavity are disposed on the water accommodating part; air supply holes for supplying air when water in the water accommodating part is pumped out are disposed on the water accommodating part; and water pumping of the water pumping structure is controlled by rotation of a rotatable mop head.

Further, the water pumping structure includes a rotating shaft that is vertically disposed in the water accommodating part and has an upper end in plug-in limiting fit with the rotatable mop head, water pumping blades disposed at a lower end of an outer ring wall of the rotating shaft, and a water outlet pipe communicated with the clean bucket cover.

Further, the clean bucket cover includes a horizontal cover plane and a water diversion slope extending downward from an outer ring of the cover plane to above the sewage accommodating cavity.

Further, a water uniformizing structure for uniformly spraying water sprayed out from the water outlet pipe along a radial direction of a rotation surface of the rotatable mop head is fixedly disposed on the clean bucket cover.

Further, the water uniformizing structure includes a water uniformizing part bulging from an upper end surface of the clean bucket cover along the radial direction of the rotation surface of the rotatable mop head; a water uniformizing cavity is disposed in the water uniformizing part; a water inlet hole corresponding to the water outlet pipe is disposed at a lower end of the water uniformizing part; a water baffle is disposed right above the water inlet hole in the water uniformizing cavity; and water spray holes are disposed on an upper end surface of the water uniformizing part at a uniform interval along the radial direction of the rotation surface of the rotatable mop head.

Further, a bristle layer is disposed above the clean bucket cover along a radial direction of a rotation surface of the rotatable mop head.

Further, a fitting pipe penetrated to above the clean bucket cover is detachably sealed above the water accommodating part; an upper end of the rotating shaft penetrates to above the fitting pipe; and an air supply gap for air to pass through is formed between the fitting pipe and the rotating shaft.

Further, the fitting pipe is in a trumpet shape with a pore diameter gradually reducing from an end close to the water accommodating part to an end away from the water accommodating part; and air supply holes communicated with the air supply gap are sunk from an inner wall of a small-diameter end of the fitting pipe.

Further, a limiting mechanism for limiting a rotation of the clean bucket cover relative to the clean water bucket is disposed between the clean bucket cover and the water pumping structure.

A second objective of the present disclosure is to provide a cleaning tool, including the mop bucket according to any one of claims 1-9, and a mop fitting with the mop bucket, wherein the mop includes a mop rod and a rotatable mop head hinged at an end part of the mop rod.

Compared with the prior art, the present disclosure has the following beneficial effects:

1. The water accommodating part is isolated from the clean water bucket, and the water pumping structure is disposed in the water accommodating part, supplementing water through the water seepage holes and balancing air pressure through the air supply holes. Through such setting, two steps of cleaning and spin-drying of the mop can be realized successively and continuously. When the water pumping structure can pump out water, a cleaning operation of the mop is carried out. Since the water pumping speed of the water pumping structure is much higher than the water supplementing speed of the water seepage holes, once the water level in the water accommodating part is too low to output water, a spin-drying operation of the mop is carried out. When a negative pressure in the water accommodating part rises, the air supply holes supply air in time to balance the pressure. Through the above structure, quantitative use of cleaning water for one cleaning period is realized, and the spin-drying is carried out right after the cleaning; and thus, the operation is easier, and more water resources are saved.

2. The clean bucket cover, in limiting lap joint with the clean water bucket, completely blocks the clean water bucket in the cleaning and spin-drying processes of the mop, thereby preventing sewage from contaminating the clean water bucket. When the clean bucket cover is removed, clean water can be added into the clean water bucket.

3. With the water uniformizing structure, the whole mop cloth can be wet quickly and uniformly, thereby improving the utilization of water and reducing the water consumption for one cleaning period of the mop.

4. With the bristle layer, the mop cleaning time is further shortened, and the total water consumption for one cleaning period is further reduced.

BRIEF DESCRIPTION OF THE DRAWINGS

The drawings are intended for further understanding of the present disclosure and constitute part of the specification. Along with the examples of the present disclosure, the drawings are used to explain the present disclosure, without constituting a limitation thereof. Among the drawings.

Figure 1:
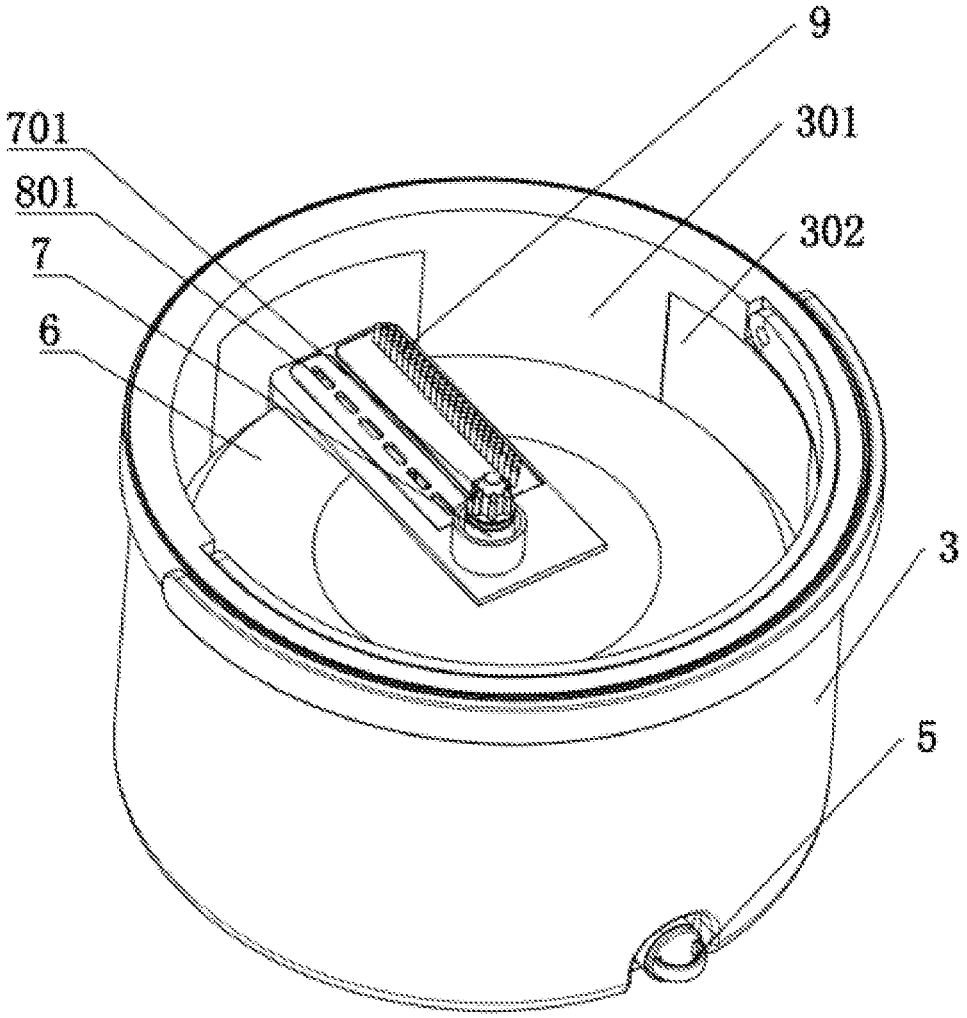
FIG. 1 is an axonometric drawing of the mop bucket of the present disclosure.

In the drawings: 1. Mop rod; 101. Inner rod; 102. Outer rod; 2. Rotatable mop head; 3. Outer bucket; 301. Fitting wall; 302. Overflow port; 303. Sewage accommodating cavity; 4. Clean water bucket; 401. Lap joint ring; 5. Drain valve; 6. Clean bucket cover; 601. Cover plane; 602. Water diversion slope; 7. Rotating shaft; 701. Spline; 8. Water uniformizing part; 801. Water spray hole; 802. Water baffle; 803. Water inlet hole; 804. Limiting pipe; 9. Bristle layer; 1001. Water accommodating part; 1002. Fitting pipe; 11. Water pumping blade; 12. Water seepage hole; 13. Water outlet pipe; 14. Air supply gap; and 15. Air supply hole.

DESCRIPTION OF THE EMBODIMENTS

The technical solutions in the examples of the present disclosure will be described clearly and completely in conjunction with the drawings therein. Apparently, only some, not all of the examples of the present disclosure are described. All other examples obtained by those of ordinary skill in the art based on the examples of the present disclosure without creative efforts are within the scope of the present disclosure.

Example

Referring to FIGS. 1-7, a cleaning tool with a mop bucket includes a mop bucket and a mop fitting with the mop bucket. The mop includes a mop rod 1 and a rotatable mop head 2 hinged at an end part of the mop rod 1; the rotatable mop head 2 is in a round shape, and a piece of mop cloth (not shown in the figures) is disposed at one end of the rotatable mop head 2 away from the mop rod 1; the mop rod 1 at least includes an inner rod 101 and an outer rod 102; the inner rod 101 and the outer rod 102 can be rotated by each other; and through cup joint, the mop rod 1 can be shortened or lengthened. The mop rod 1 is an ordinary rotatable mop rod 1 on the market, with the inner rod 101 and the outer rod 102 making unidirectional rotating movements in a shortening process; the specific structure can be the structure of the mop rod 1 of ZL 201010286478.7 among existing designs, in which rotation of the rotatable mop head 2 is realized in repeated processes of shortening and lengthening of the mop rod 1. The mop bucket includes an outer bucket 3 and a clean water bucket 4 located in the outer bucket 3; a sewage accommodating cavity 303 is formed between the outer bucket 3 and the clean water bucket 4; a clean bucket is clamped on the outer bucket 3; an upper end of the outer bucket 3 extends inward to form a fitting wall 301; and an upper end of the clean water bucket 4 extends outward to form a lap joint ring 401. Through fit between the clean water bucket 4 and the outer bucket 3, the lap joint ring 401 is clamped into a lower end of the fitting wall 301; overflow ports 302 allowing sewage to enter the sewage accommodating cavity 303 are disposed at an interval along the peripheral direction of the outer bucket 3 on the fitting wall 301; and a drain valve 5 for discharging sewage is disposed at a lower end of the outer bucket 3.

Figure 3:
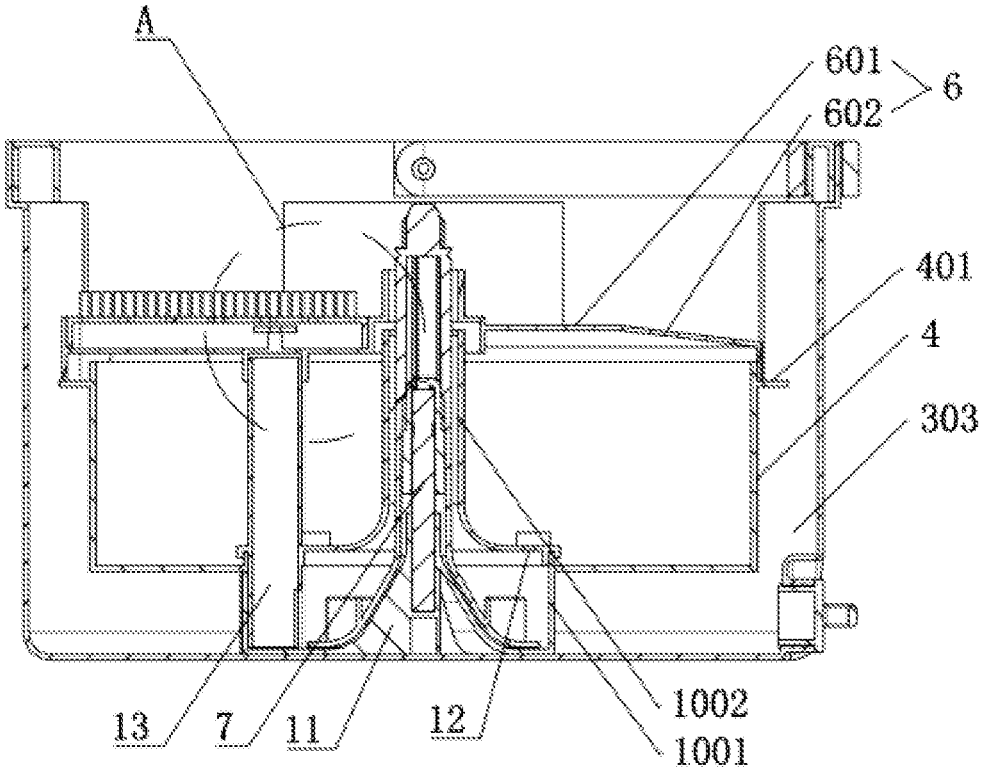
FIG. 3 is a sectional view of A-A of FIG. 2.
Figure 4:
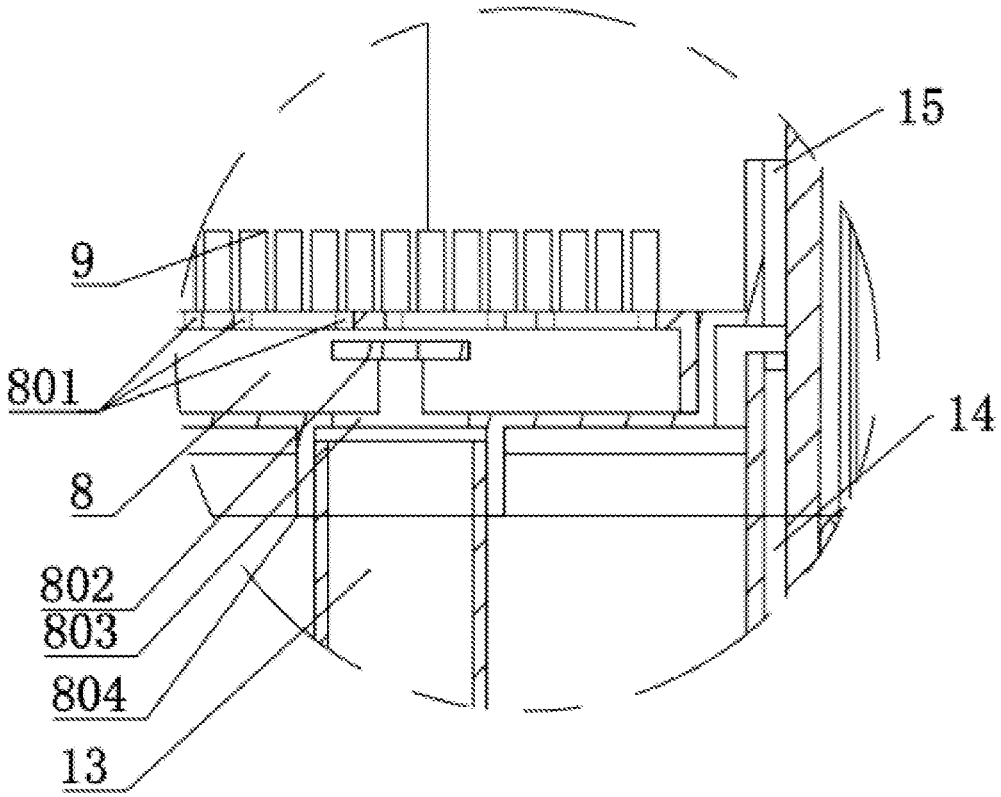
FIG. 4 is an enlarged view of A in FIG. 3.
Figure 5:
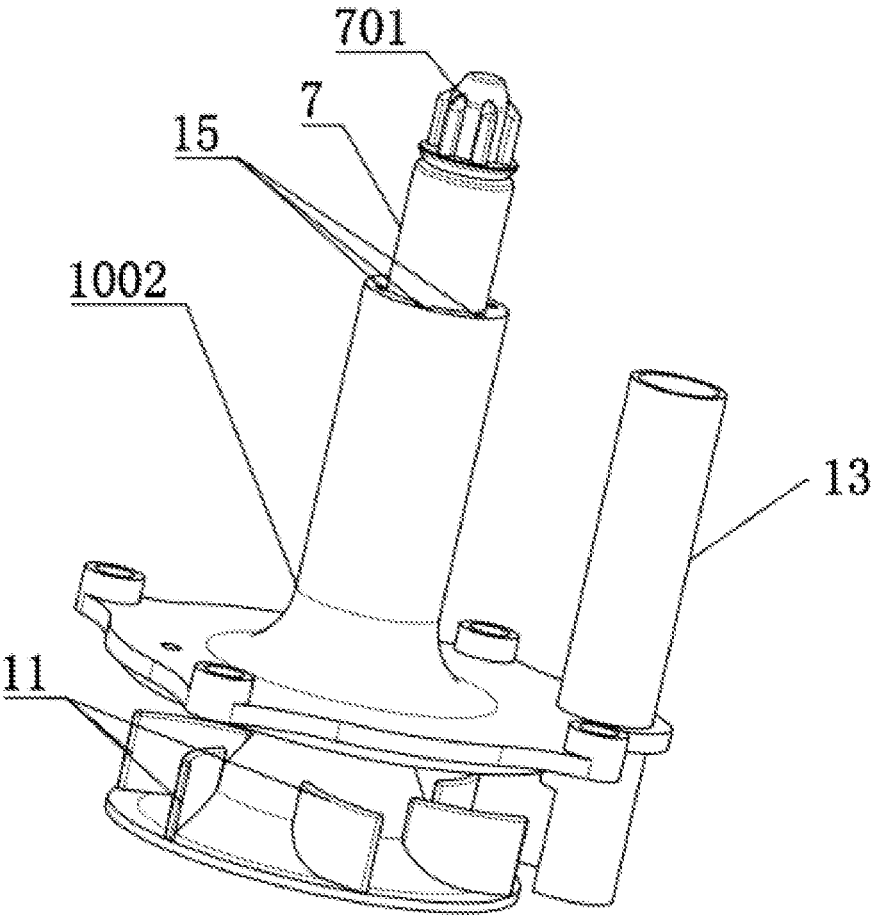
FIG. 5 is an axonometric drawing of the water pumping structure of the present disclosure.
Figure 6:
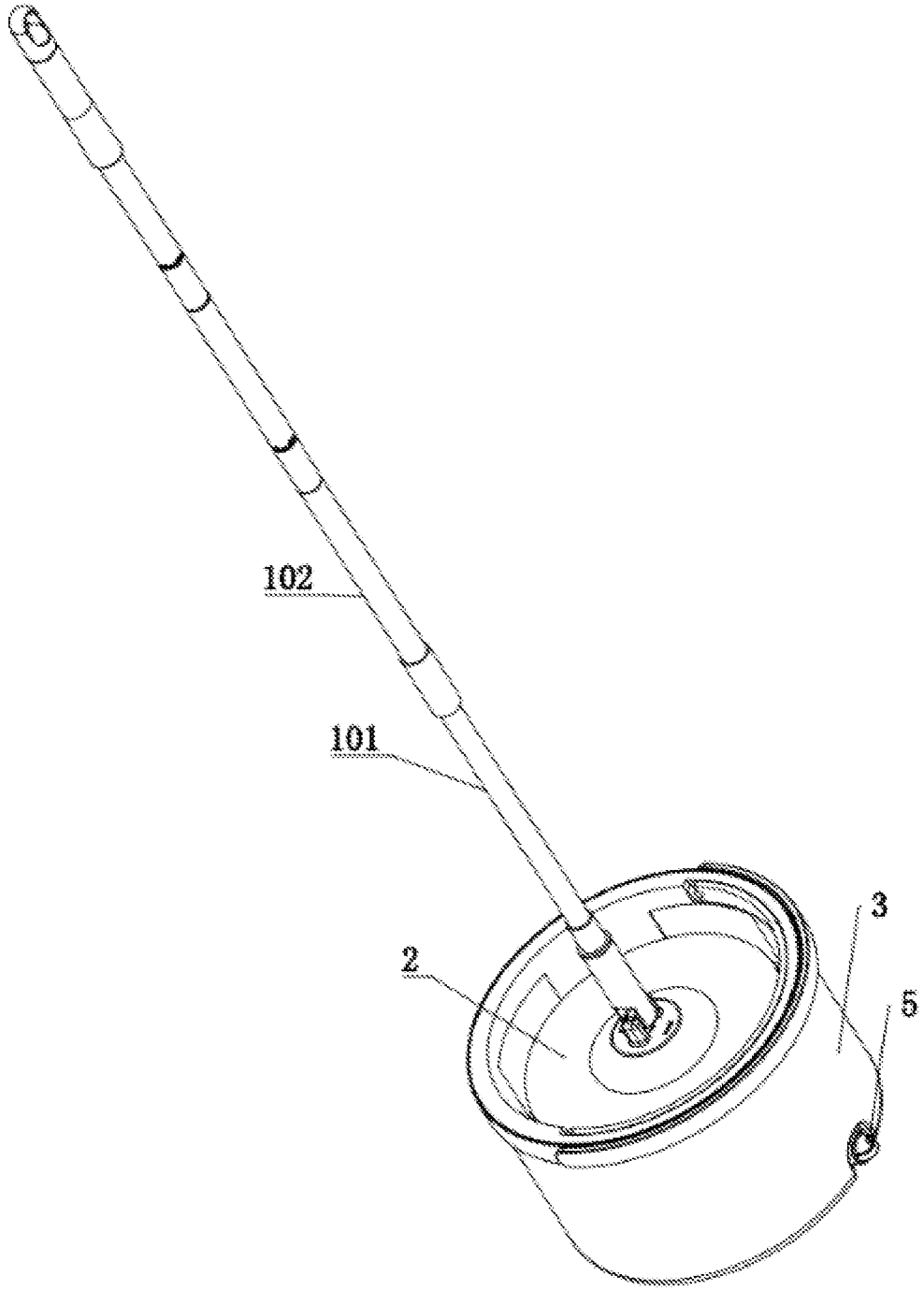
FIG. 6 is an axonometric drawing of the cleaning tool with a mop bucket of the present disclosure.
Figure 7:
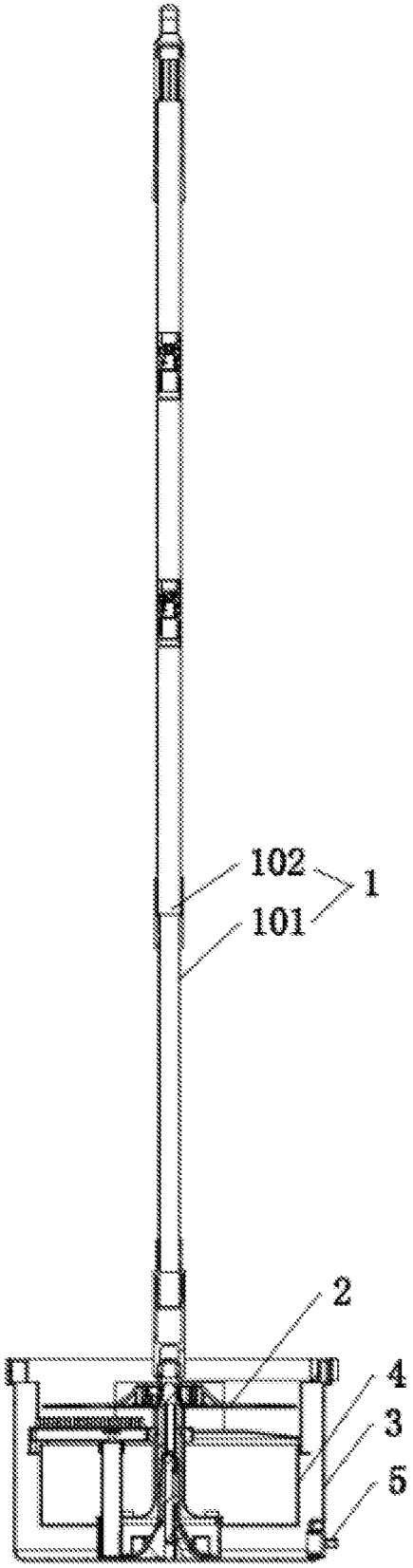
FIG. 7 is a sectional view of the cleaning tool with a mop bucket of the present disclosure.

A water accommodating part 1001 capable of accommodating amount of water required for one cleaning period is fixedly disposed in the clean water bucket 4. Referring to FIGS. 3-5 for details, the water accommodating part 1001 is a water accommodating cavity formed by a lower end surface of the clean water bucket 4 sinking downward; a fitting pipe 1002 penetrated to above a clean bucket cover 6 is detachably sealed above the water accommodating part 1001; the fitting pipe 1002 is fixed above the water accommodating part 1001 by a bolt, and a seal ring is disposed between the fitting pipe 1002 and the water accommodating part 1001; the clean bucket cover 6 is disposed on the clean water bucket 4; the clean bucket cover 6 includes a horizontal cover plane 601 and a water diversion slope 602 extending downward from an outer ring of the cover plane 601 to above a sewage accommodating cavity 303; a water pumping structure for driving the rotatable mop head 2 to rotate on the clean bucket cover 6 and capable of pumping water in the water accommodating part 1001 to above the clean bucket cover 6 is disposed in the water accommodating part 1001; water seepage holes 12 communicated with the clean water bucket 4 and enabling clean water in the clean water bucket 4 to drop into the water accommodating cavity are disposed on the water accommodating part 1001; air supply holes 15 for supplying air when water in the water accommodating part 1001 is pumped out are disposed on the water accommodating part 1001; and water pumping of the water pumping structure is controlled by rotation of the rotatable mop head 2. When the rotatable mop head 2 rotates, the water pumping structure pumps clean water in the water accommodating part 1001 to above the clean bucket cover 6; and at the time, the rotatable mop head 2 carries out a cleaning operation, and sewage falls from the clean bucket cover 6 into the sewage accommodating cavity 303. Since the water pumping speed is much higher than the water seepage speed, as the water in the water accommodating part 1001 is pumped out gradually, a negative pressure is formed in the water accommodating part 1001 so that air automatically fills the water accommodating part 1001 through the air supply holes 15, then the water pumping structure fails to pump water; and at the time, the mop carries out a dewatering operation.

Referring to FIG. 5, the water pumping structure includes a rotating shaft 7 that is vertically disposed in the water accommodating part 1001 and has an upper end penetrated to an upper end of the water accommodating part 1001 and is in plug-in limiting fit with the rotatable mop head 2, water pumping blades 11 disposed at a lower end of an outer ring wall of the rotating shaft 7, and a water outlet pipe 13 that vertically extends upward from a side wall of the water accommodating part 1001 and then is communicated with the clean bucket cover 6. The water pumping blades 11 are disposed at an interval along the peripheral direction of the rotating shaft 7; an upper end of the rotating shaft 7 is configured as a spline 701; and a lower end of the rotatable mop head 2 is sunk to form a key slot for inserting the spline 701. Through plug-in fit between the rotatable mop head 2 and the rotating shaft 7, rotation of the rotatable mop head 2 can be realized through the repeated processes of shortening and lengthening of the mop rod 1, and then the water pumping blades 11 are driven to rotate to realize water pumping.

In order to realize smooth entry of air into the water accommodating part 1001, an air supply gap 14 for air to pass through exists between the fitting pipe 1002 and the rotating shaft 7; the fitting pipe 1002 is in a trumpet shape with a pore diameter gradually reducing from an end close to the water accommodating part 1001 to an end away from the water accommodating part 1001; air supply holes 15 communicated with the air supply gap 14 are sunk from an inner wall of a small-diameter end of the fitting pipe 1002; and a plurality of air supply holes 15, 6 in the present solution, are disposed at a uniform interval along the peripheral direction of the rotating shaft 7.

Figure 2:
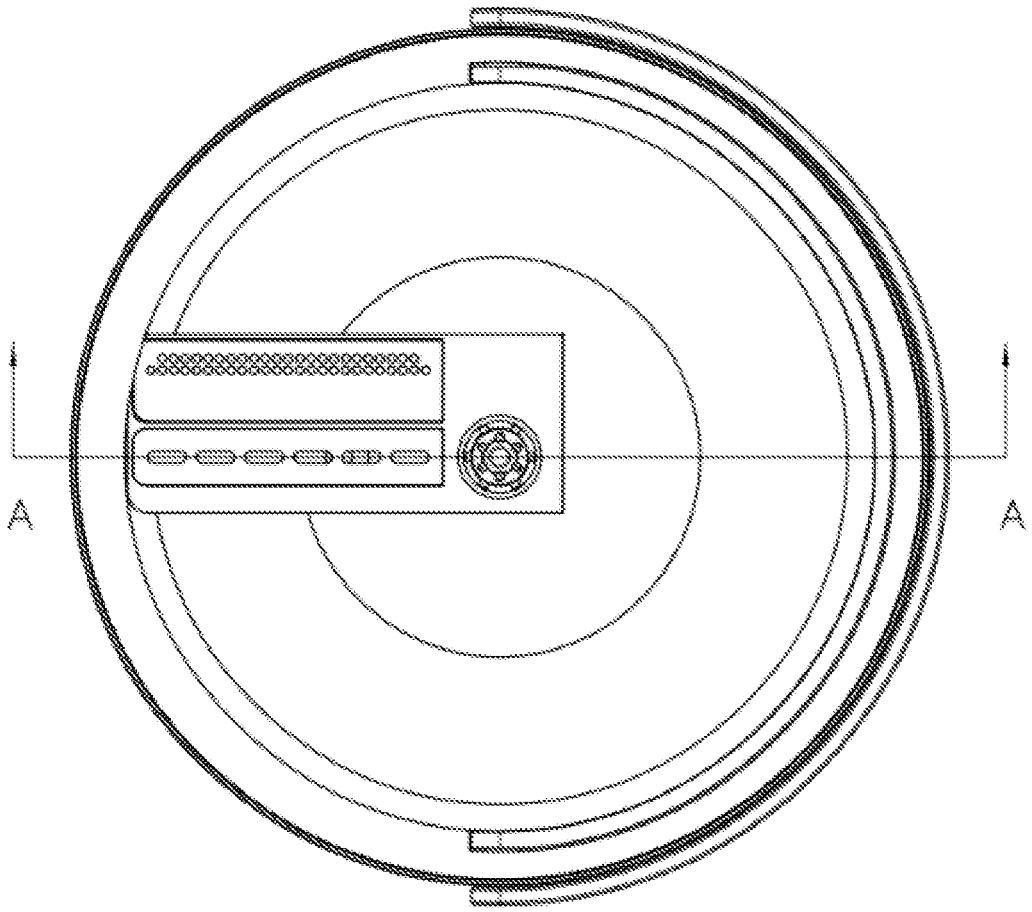
FIG. 2 is a top view of the mop bucket of the present disclosure.

In order to improve the utilization of water, a water uniformizing structure for uniformly spraying water sprayed out from a water outlet pipe 13 along a radial direction of a rotation surface of the rotatable mop head 2 is fixedly disposed on the clean bucket cover 6. Referring to FIGS. 1-3, the water uniformizing structure includes a water uniformizing part 8 bulging from an upper end surface of the clean bucket cover 6 along the radial direction of the rotation surface of the rotatable mop head 2, a water inlet hole 803 disposed at a lower end of the water uniformizing part 8 and corresponding to the water outlet pipe 13, a water baffle 802 disposed right above the water inlet hole 803, and water spray holes 801 disposed on an upper end surface of the water uniformizing part 8 at a uniform interval along the radial direction of the rotation surface of the rotatable mop head 2. When clean water is sprayed out from the water outlet pipe 13, the water baffle 802 blocks the clean water to avoid vertical upward spray; and the clean water uniformly fills the water uniformizing part 8 from two sides of the water baffle 802 and then is uniformly sprayed from the water spray holes 801 above the water uniformizing part 8. Through fit between the water uniformizing structure and the rotation of the rotatable mop head 2, the whole mop cloth can be uniformly wet.

In order to improve the cleaning strength of the mop cloth, a bristle layer 9 is disposed above the clean bucket cover 6 along the radial direction of the rotation surface of the rotatable mop head 2. When the rotatable mop head 2 rotates, the bristle layer 9 can brush the whole mop cloth so as to brush away stains on the mop cloth.

In order to prevent the rotating mop from driving the clean bucket cover 6 to rotate, a limiting mechanism for limiting a rotation of the clean bucket cover 6 relative to the clear water bucket 4 is disposed between the clean bucket cover 6 and the water pumping structure. The limiting mechanism includes a limiting pipe 804 vertically extending downward from a lower end surface of the water inlet hole 803 and used for inserting the water outlet pipe 13; and the pore diameter of the water inlet hole 803 is less than the outer diameter of the water outlet pipe 13. When the clean bucket cover 6 is in cup joint with the rotating shaft 7, the limiting pipe 804 is in cross fit with the water outlet pipe 13, and a lower end surface of the clean bucket cover 6 is located on an upper end surface of the fitting pipe 1002. Through the limiting pipe 804, the rotation of the clean bucket cover 6 relative to the rotating shaft 7 is limited, then the rotatable mop head 2 in rotation is always maintained at a static state, thereby ensuring that the water uniformizing structure can uniformly supply water to the whole mop cloth so that the bristle layer can uniformly brush the whole mop cloth.

When the cleaning tool of the present solution is adopted for cleaning, the clean bucket cover 6 is removed, then the clean water bucket 4 is filled with clean water before standing for a while. After the water in the clean water bucket 4 fills the water accommodating part 1001, the clean water bucket 4 is lap jointed to the clean bucket cover 6, the rotatable mop head 2 is made in key fit with the rotating shaft 7, and then the mop rod 1 is repeatedly shortened and lengthened up and down to realize rotation of the rotatable mop head 2; and the rotatable mop head 2 rotates to drive the rotating shaft 7 and the water pumping blades 11 to rotate, prompting the water in the water accommodating part 1001 to be sprayed out from the water outlet pipe 13. Clean water, after being blocked by the water baffle 802, quickly fills the water uniformizing part 8 and then is uniformly sprayed out from the water spray holes 801 on the water uniformizing part 8 to wet the whole mop cloth. The mop cloth spins off sewage and absorbs clean water at the same time while being cleaned under the effect of the bristle layer 9. Since the water seepage speed of the water seepage holes 12 is much lower than the water output speed of the water outlet pipe 13, a negative pressure in the water accommodating cavity rises; and at the time, air fills the water accommodating part 1001 through the air supply holes 15. When the water level in the water accommodating part 1001 is so low that the water pumping blades 11 cannot pump water to the water outlet pipe 13, the water spray holes 801 stops spraying water; and at the time, the mop cloth is in a spin-drying state which can be used for spin-drying of the mop cloth. After the spin-drying of the mop cloth, a floor mopping operation can be carried out. In the process of floor mopping, the water in the clean water bucket 4 re-fills the water accommodating part 1001 under the effect of the water seepage holes 12 for next cleaning. Sewage can be discharged with a drain valve 5.

At last, it should be noted that the examples described above are only preferred examples of the present disclosure, and not intended to limit the present disclosure. Although the present disclosure is elaborated on by referring to the above-mentioned examples, those skilled in the art can make modifications to the technical solutions recorded by the above-mentioned examples, or equivalent substitutions to some technical features therein. Any modification, equivalent substitution, improvement and the like made within the spirit and principle of the present disclosure shall be included in the scope of the present disclosure.

What is claimed is:

1. A mop bucket, comprising an outer bucket and a clean water bucket located in the outer bucket, and a sewage accommodating cavity being formed between the outer bucket and the clean water bucket, wherein a water accommodating part is fixedly disposed in the clean water bucket; the water accommodating part is equipped with a water accommodating cavity capable of accommodating water required for one cleaning period; a clean bucket cover is disposed on the clean water bucket; a water pumping structure capable of pumping water in the water accommodating part to above the clean bucket cover is disposed in the water accommodating part; water seepage holes communicated with the clean water bucket and enabling clean water in the clean water bucket to drop into the water accommodating cavity are disposed on the water accommodating part; air supply holes for supplying air when water in the water accommodating part is pumped out are disposed on the water accommodating part; and water pumping of the water pumping structure is controlled by rotation of a rotatable mop head;

wherein the water pumping structure comprises a rotating shaft that is vertically disposed in the water accommodating part and has an upper end in plug-in limiting fit with the rotatable mop head, water pumping blades disposed at a lower end of an outer ring wall of the rotating shaft, and a water outlet pipe communicated with the clean bucket cover;

wherein a water uniformizing structure for uniformly spraying water sprayed out from the water outlet pipe along a radial direction of a rotation surface of the rotatable mop head is fixedly disposed on the clean bucket cover; and wherein the water uniformizing structure comprises a water uniformizing part bulging from an upper end surface of the clean bucket cover along the radial direction of the rotation surface of the rotatable mop head; a water uniformizing cavity is disposed in the water uniformizing part; a water inlet hole corresponding to the water outlet pipe is disposed at a lower end of the water uniformizing part; a water baffle is disposed right above the water inlet hole in the water uniformizing cavity; and water spray holes are disposed on an upper end surface of the water uniformizing part at a uniform interval along the radial direction of the rotation surface of the rotatable mop head.

2. The mop bucket according to claim 1, wherein the clean bucket cover comprises a horizontal cover plane and a water diversion slope (602) extending downward from an outer ring of the cover plane to above the sewage accommodating cavity.

3. The mop bucket according to claim 1, wherein a bristle layer is disposed above the clean bucket cover along a radial direction of a rotation surface of the rotatable mop head.

4. The mop bucket according to claim 1, wherein a fitting pipe penetrates to above the clean bucket cover is detachably sealed above the water accommodating part; an upper end of the rotating shaft penetrates to above the fitting pipe; and an air supply gap for air to pass through is formed between the fitting pipe and the rotating shaft.

5. The mop bucket according to claim 4, wherein the fitting pipe is in a trumpet shape with a pore diameter gradually reducing from an end close to the water accommodating part to an end away from the water accommodating part; and air supply holes communicated with the air supply gap are sunk from an inner wall of a small-diameter end of the fitting pipe.

6. The mop bucket according to claim 1, wherein a position-limit mechanism for limiting a rotation of the clean bucket cover relative to the clean water bucket is disposed between the clean bucket cover and the water pumping structure.

7. A cleaning tool, comprising the mop bucket according to claim 1, wherein comprises a mop configured to mate with the mop bucket, the mop comprises a mod rod and the rotatable mop head hinged at an end part of the mop rod.

* * * * *